US005336395A

United States Patent [19]

Pabst et al.

[11] Patent Number: 5,336,395

[45] Date of Patent: * Aug. 9, 1994

[54] LIQUEFACTION OF COAL WITH AQUEOUS CARBON MONOXIDE PRETREATMENT

[75] Inventors: Joanne K. Pabst, Crosby, Tex.; William E. Winter, Jr., Baton Rouge, La.; Stephen N. Vaughn, Baton Rouge, La.; Claude C. Culross, Baton Rouge, La.; Steve D. Reynolds, Baton Rouge, La.

[73] Assignee: Exxon Research and Engineering Company, Florham Park, N.J.

[ * ] Notice: The portion of the term of this patent subsequent to May 5, 2009 has been disclaimed.

[21] Appl. No.: 41,135

[22] Filed: Mar. 29, 1993

Related U.S. Application Data

[63] Continuation of Ser. No. 762,059, Sep. 19, 1991, abandoned, which is a continuation of Ser. No. 455,689, Dec. 21, 1989, abandoned.

[51] Int. Cl.[5] ..... C10G 1/06

[52] U.S. Cl. ..... 208/403; 208/420; 208/427; 208/430; 208/433; 208/435

[58] Field of Search ..... 208/430, 433, 435, 420, 208/427, 403

[56] References Cited

U.S. PATENT DOCUMENTS

| | | | |
|---|---|---|---|
| 3,642,607 | 2/1972 | Seitzer | 208/8 |
| 3,796,650 | 3/1974 | Urban . | |
| 3,808,119 | 4/1974 | Bull et al. | 208/433 |
| 3,846,275 | 11/1974 | Urban . | |
| 3,884,796 | 5/1975 | Hinderliter et al. . | |
| 3,909,390 | 9/1975 | Urban . | |
| 3,920,536 | 11/1975 | Seltzer et al. . | |
| 3,930,984 | 1/1976 | Pitchford | 208/433 |
| 4,028,220 | 6/1977 | Urquhart . | |
| 4,077,867 | 3/1978 | Aldridge et al. | 208/421 X |
| 4,128,471 | 12/1978 | Malone et al. . | |
| 4,144,033 | 3/1979 | Nakako et al. . | |
| 4,260,471 | 4/1981 | Miller | 208/433 |
| 4,298,451 | 11/1981 | Neuworth | 208/433 X |
| 4,330,390 | 5/1982 | Rosenthal et al. | 208/430 X |
| 4,338,183 | 7/1982 | Gatsis | 208/10 |
| 4,491,511 | 1/1985 | Skinner et al. | 208/433 X |
| 4,523,986 | 6/1985 | Seufert | 208/427 X |
| 5,026,475 | 7/1991 | Stuntz et al. | 208/413 |
| 5,071,540 | 12/1991 | Culross et al. | 208/413 |
| 5,110,450 | 5/1992 | Culross et al. | 208/413 |
| 5,151,173 | 9/1992 | Vaughn et al. | 208/420 |
| 5,200,063 | 4/1993 | Neskora et al. | 208/430 |

FOREIGN PATENT DOCUMENTS

| | | | |
|---|---|---|---|
| 1232219 | 2/1988 | Canada . | |
| 0264743 | 4/1988 | European Pat. Off. | 208/433 |

OTHER PUBLICATIONS

S. D. Brandes, et al.; *Coal Pretreatment, Chemistry and Technology*; U.S. Dept. of Energy, Pittsburgh, Pa. 15236; SRI International, Menlo Park Calif. 94025 EP-311-164-A, Single-step coal liquefaction process—using carbon monoxide, aq. alkali for hydrogen prodn. by conversion, and a transition metal hydrogenation catalyst Sep. 8, 1987-Aug. 27, 1989.

*Primary Examiner*—Paul Lieberman
*Assistant Examiner*—Patricia L. Hailey
*Attorney, Agent, or Firm*—Henry E. Naylor

[57] ABSTRACT

This invention is directed to a staged process for producing liquids from coal or similar carbonaceous feeds combining a pretreatment stage and a liquefaction stage. In the process, the feed is reacted with carbon monoxide and water at an elevated temperature and pressure. The so pretreated coal is sent to a liquefaction reactor, wherein the coal is reacted at a somewhat higher temperature in the presence of hydrogen and catalyst to produce valuable liquid fuels or feedstocks.

35 Claims, 7 Drawing Sheets

LIQUEFACTION OF COAL WITH AQUEOUS CARBON MONOXIDE PRETREATMENT

This application is a continuation of application Ser. No. 07/762,059, filed Sep. 19, 1991, now abandoned, which is a continuation of application Ser. No. 455,689, filed Dec. 21,1989, now abandoned.

This invention relates to a process for liquefying coal, in particular, a multi-stage process comprising in sequence a pretreatment stage and a catalytic hydroconversion stage.

BACKGROUND OF THE INVENTION

1. Field of the Invention

The petroleum industry has long been interested in the production of "synthetic" liquid fuels from non-petroleum solid fossil fuel sources. It is hoped that economic non-petroleum sources of liquid fuel will help the petroleum industry to meet growing energy requirements and decrease dependence on foreign supplies.

Coal is the most readily available and most abundant solid fossil fuel, others being tar sands and oil shale. The United States is particularly richly endowed with well distributed coal resources. Additionally, in the conversion of coal to synthetic fuels, it is possible to obtain liquid yields of about three to four barrels per ton of dry coal, or about four times the liquid yield/ton of other solid fossil fuels such as tar sands or shale, because these resources contain a much higher proportion of mineral matter.

Despite the continued interest and efforts of the petroleum industry in coal liquefaction technology, further improvements are necessary before it can reach full economic status. Maximizing the yield of coal liquids is important to the economics of coal liquefaction.

The present invention relates to an improved process for converting coal to liquid hydrocarbon products in a catalytic hydroconversion process. The improvement relates to a coal pretreatment stage comprising subjecting the coal to aqueous carbon monoxide under specific pressure and temperature conditions. Such pretreatment improves the reactivity of the coal in the subsequent liquefaction stage of the overall process. The liquefaction stage can be advantageously carried out using a catalyst prepared from a small amount of an oil soluble organometallic compound. The catalyst is preferably formed in-situ within the feed to the liquefaction stage reactor.

2. Description of the Prior Art

The known processes for producing liquid fuels from coal can be grouped into four broad categories: direct hydrogenation, donor solvent hydrogenation, Fischer-Tropsch synthesis (via gasification), and pyrolysis (see Kirk Othmer - Fuels). The present invention falls into the category of direct hydrogenation.

The direct hydrogenation of coal in the presence of solvent and catalyst was first developed in Germany prior to World War II. In such a process, a slurry of coal in a suitable solvent was reacted in the presence of molecular hydrogen at an elevated temperature and pressure.

A number of previous co-assigned patents disclose coal liquefaction processes utilizing hydroconversion catalysts which are micron sized particles comprised of a metal sulfide in a carbonaceous matrix. These catalysts are generally formed from certain soluble or highly dispersed organometallic compounds or precursors.

These precursors are converted into catalyst particles by heating in the presence of an hydrogen-containing gas. The catalyst particles are highly dispersed in the feed being treated during hydroconversion. Among the various patents in this area are U.S. Pat. Nos. 4,077,867, 4,094,765, 4,149,959, 4,298,454; and 4,793,916. Other patents disclose catalysts similar to the above except that the catalytically active metal compound is supported on finely divided particles of solid metals and metal alloys, for example as disclosed in U.S. Pat. Nos. 4,295,995 and 4,357,229.

The conversion of coal in aqueous/CO is well known, dating back to Fischer and Schrader in 1921 (F. Fisher & H. Schrader, Bennst. Chem., 2, 257, 1921). Several liquefaction processes, including the U.S. Bureau of Mines COSTEAM process (H. R. Appell, E. C. Moroni, R. D. Miller, Energy Sources, 3, 163, (1971), have been developed based on using aqueous/CO or aqueous/syngas at 750°-850° F. in the primary conversion block for lignites (low rank coals).

An object of the present invention is to provide a novel process for the conversion of carbonaceous solids such as coal in order to produce valuable liquid hydrocarbonaceous products.

A further object of the present invention is to provide an improved process for producing liquid hydrocarbonaceous products from coal, the improvement comprising utilizing a pretreatment step wherein the coal, as an aqueous slurry, is subjected to reaction with carbon monoxide.

A particular object of the present invention is to pretreat coal in a specific temperature range to generate a more reactive coal for coal liquefaction, thereby obtaining more products, with higher selectivity to liquids over gases.

Another object of the present invention is to improve the efficiency in the utilization of molecular hydrogen in the transformation of coal to valuable liquids.

Another object of the present invention is to increase the thermal efficiency of a coal liquefaction plant by providing a more efficient coal dewatering and coal partial oxidation operation.

Additional advantages of the present coal conversion process will become apparent in the following description.

SUMMARY OF THE INVENTION

In accordance with the present invention, there is provided a process for liquefying coal to produce an oil, which comprises: (a) pretreating the coal by forming a mixture of coal, carbon monoxide and water, and subjecting the mixture to an elevated temperature and pressure; (b) removing gases and $H_2O$ from the coal mixture; (c) forming a subsequent mixture of the pretreated coal, solvent, and catalyst, wherein the catalyst is a carbonaceous supported metal containing oxide or sulfide, preferably a conversion product of an oil-soluble metal containing compound, said metal being selected from the group consisting of Groups VA, VIA, VIIA and VIIIA of the Periodic Table of Elements, and mixtures thereof; (d) reacting the latter mixture with a gas largely comprised of molecular hydrogen under coal liquefaction conditions, in a liquefaction zone, and (e) recovering an oil product.

In accordance with another embodiment of the invention, there is provided a process for liquefying coal to produce an oil, which comprises: (a) subjecting a mixture of coal, water and carbon monoxide to a temperature of 550° F. to 650° F. and a carbon monoxide partial pressure of 500 to 5000 psi for a period of at least 10 minutes, (b) removing gases and $H_2O$ from the coal mixture; (c) forming a subsequent mixture of the pretreated coal, solvent, and catalyst, wherein the catalyst is a carbonaceous supported metal-containing oxide or sulfide, preferably a conversion product of an organic oil-soluble metal containing compound, said metal being selected from the group consisting of Groups VA, VIA, VIIA and VIIIA of the Periodic Table of the Elements and mixtures thereof; (d) reacting the latter mixture with a gas comprising molecular hydrogen under coal liquefaction conditions, in a liquefaction zone, and (e) recovering an oil product.

BRIEF DESCRIPTION OF DRAWINGS

The process of the invention will be more clearly understood upon reference to the detailed discussion below and upon reference to the drawings wherein.

DESCRIPTION OF THE PREFERRED EMBODIMENTS

Figure 1:
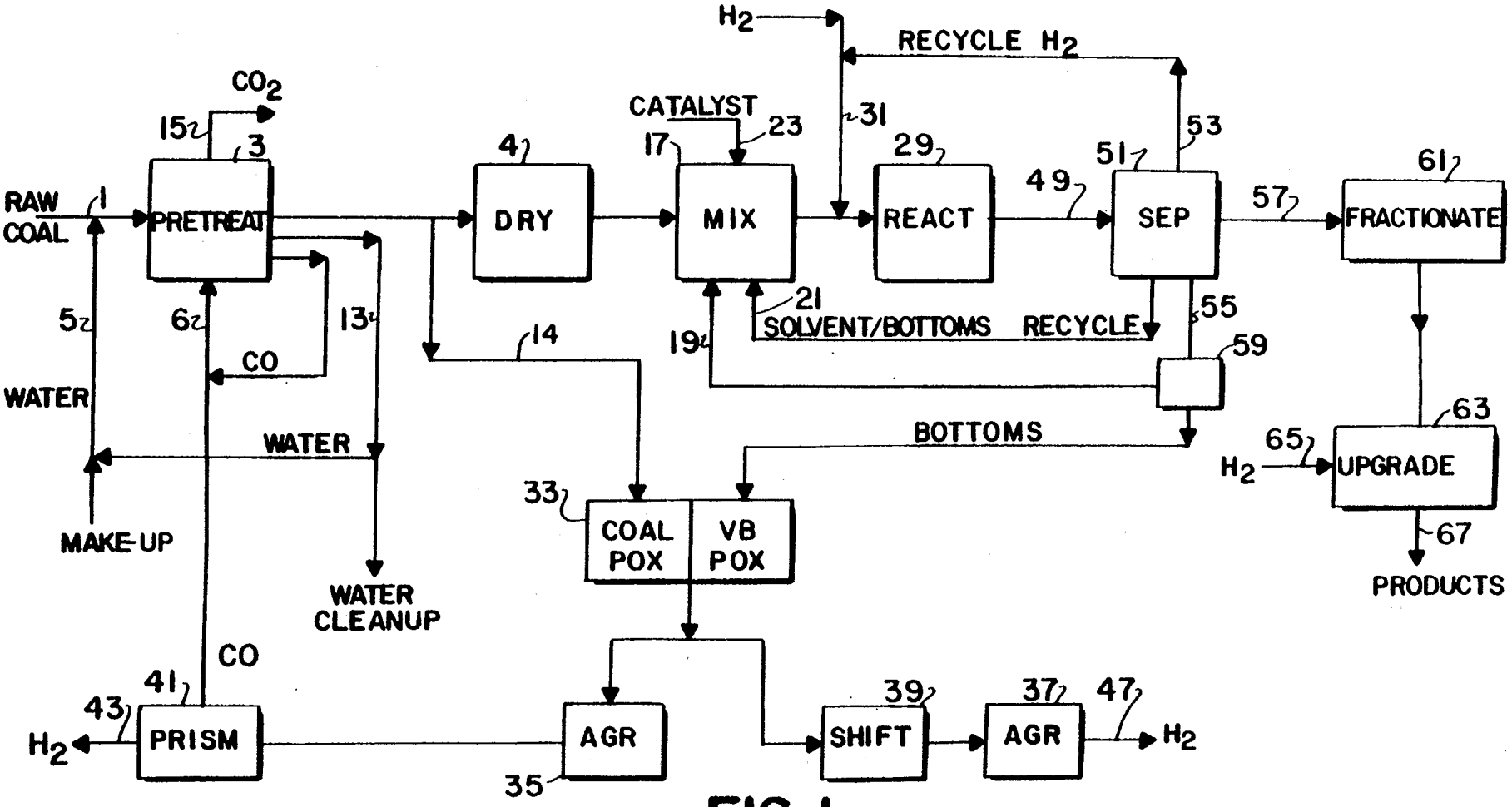
FIG. 1 shows a process flow diagram illustrating the subject invention wherein coal is pretreated in the presence of aqueous carbon monoxide and thereafter converted into valuable liquids.

The process of the invention is generally applicable to hydroconvert coal to coal liquids (i.e., an oil or normally liquid hydrocarbon product) under catalytic hydroconversion conditions. The process comprises a pretreatment stage and a liquefaction stage. In the pretreatment stage, a coal feed is pretreated with carbon monoxide (or a gaseous mixture such as syngas containing carbon monoxide) and water at an elevated temperature and pressure. During this stage, only small amounts of very light liquids are formed. The coal is separated from gases and water and thereafter sent to a liquefaction reactor. In the liquefaction reactor the coal is reacted at an elevated temperature in the presence of hydrogen, a vehicle solvent and catalyst to produce coal liquids.

The term "coal" is used herein to designate a normally solid carbonaceous material including all ranks of coal below anthracite, such as bituminous coal, subbituminous coal, lignite, peat and mixtures thereof. The sub-bituminous and lower ranks of coal are particularly preferred.

The raw material for the present process is coal that has been first reduced to a particulate or comminuted form. The coal is suitably ground or pulverized to provide particles of a size ranging from 10 microns up to about $\frac{1}{4}$ inch particle size diameter, typically about 8 mesh (Tyler).

Pretreatment. According to the present process, the coal feedstock is pretreated by being subjected to an aqueous carbon monoxide environment. Coal is reacted in the pretreatment stage at relatively mild temperatures (550°–650° F.). A limited amount of volatile hydrocarbon liquids are produced during the pretreatment stage (typically less than about 10% by daf weight). However, the coal is hydrogenated and depolymerized, and the moisture and oxygen levels are reduced. After such pretreatment, not only are the properties of the coal upgraded, but the coal shows enhanced reactivity for further processing. In particular, the pretreatment significantly increases the coal's value as feedstock for coal liquefaction. The severity of the coal liquefaction conditions can be reduced while increasing liquid yields and selectivity to light liquids, reducing gas make, and lowering hydrogen consumption. The coal can reach a significantly higher daf wt% (dry ash free weight %) conversion following pretreatment.

Unlike most hydroconversion systems, which are based on thermal/free radical chemistry, the aqueous chemistry of the present pretreatment stage is generally believed to operate through an ionic mechanism. Studies have indicated multiple independent reaction pathways in the pretreatment step, including an hydrogenation pathway which results in an increased H/C (hydrogen to carbon) ratio and increased volatile matter content. In this pathway, the mechanism which was proposed by H. R. Appell (H. R. Appell, R. D. Miller, R. G. Illig, R. C. Moroni, F. W. Steffgen, Report PETC/TR-79/1, 1979) is still widely accepted, wherein the active intermediate is a formate-type anion which is formed by the addition of base to the system, as follows:

$$\begin{array}{l} CO + OH^- \longrightarrow HCO_2^- \\ HCO_2^- + [COAL] \longrightarrow [COAL]H^- + CO_2 \\ [COAL]H^- + H_2O \longrightarrow [COAL]H_2 + OH^- \\ \hline H_2O + CO + [COAL] \longrightarrow [COAL]H_2 + CO_2 \end{array}$$

Thus, donatable hydrogen is incorporated into the coal. For example, hydrogenation of ring systems in the coal matrix to form hydroaromatics is thought to be facilitated. Hydroaromatics comprise one class of compounds that can donate hydrogen to cap free radicals during liquefaction and thus mitigate undesirable condensation reactions which yield less reactive bottoms. This hydrogenation of the coal during pretreatment is thought to be a major factor responsible for its enhanced reactivity. The pretreatment has the effect of increasing the volatile matter content of the coal. In general, increased volatile matter content corresponds to more highly reactive coals during subsequent liquefaction. The pretreated coal appears to behave during subsequent coal liquefaction like unpretreated raw coal having the same volatile matter content. For example, pretreatment in aqueous CO can make low rank coals behave like bituminous coals by reducing the water and oxygen levels prior to liquefaction as well as hydrogenating the coal and increasing the volatile matter content, thereby increasing the barrels per ton yield. This is economically quite significant since, for example, a Wyoming subbituminous coal may be only about 30% the cost of an Illinois bituminous coal, and a Victorian brown coal may only be about 20% the cost of an Illinois bituminous coal, on a dollar per MBTU basis.

In another reaction pathway occurring during coal pretreatment, coal depolymerization reactions occur. Depolymerization is detected by an increased solubility in various solvents. The increased solubility as a result of pretreatment may also enhance reactivity during liquefaction. The role of the aqueous carbon monoxide pretreatment in depolymerizing coal is not well understood and has been the subject of some work in the literature. The ability to depolymerize coal has been variously attributed to bond breaking activity, or to the removal of potential cross link sources which cause repolymerization to higher molecular weight products following thermal bond rupture.

Much of the aqueous chemistry involved in aqueous carbon monoxide coal pretreatment is believed to involve oxygen containing substituents attached to aromatic ring systems. The effect of pretreatment is especially evident with oxygen rich coals. The pre-treatment promotes decarboxylation of the coal and there is evidence that it also promotes some ether and ester cleavage in the coal.

Pretreatment of coal according to the present invention is suitably carried out in a reactor of conventional construction and design capable of withstanding the hereafter described conditions of pretreatment. A stainless steel cylindrical vessel with inlet lines for the coal slurry and carbon monoxide and product removal lines is suitable.

The pretreatment process conditions can have a large impact on the results. For example, it is economically desirable to minimize the "at conditions" (operating conditions) liquid water-to-dry coal weight ratio ("at conditions", as compared to "inlet conditions", excludes water evaporated to steam, and water lost via the water gas shift reaction). However, a weight ratio of liquid water to dry coal of at least about 0.5:1 is required. If the ratio is below this value, the product coal properties are poor. The preferred "at condition" ratio is about 0.5:1 to 2:1, most preferably above 1:1. The preferred inlet ratio is about 1.25:1 to 4:1, most preferably 1.5:1 to 2:1 and at least 1:1. A portion of the required water is inherently present in coal; the remainder must be added.

When using water as the solvent, it is desirable to minimize the amount of water which will be heated up in the pretreatment reactor. Therefore, the coal is fed into the reactor at the minimum pumpable water/solid ratio, which is about 1.25/1 on a weight basis (while simultaneously maintaining at least 0.5:1 in the reactor). The limit for pumpability will be variable and dependent upon the physical properties of a given coal. Similarly, there are a number of economic incentives for minimizing the carbon monoxide treat rate in the pretreatment reactor, including reducing the amount of water which would be flashed during the separation step, and decreasing compression and gas cleanup requirements.

In a preferred embodiment of the pretreatment stage, an added organic solvent immiscible or miscible with water, is employed to enhance coal dispersion and flowability. An organic co-solvent helps prevent the pretreated coal from agglomerating and sticking vessels and lines in a continuous processing scheme. The ratio of organic solvent-to-coal is preferably about 0.25:1 to 2:1. Suitable organic co-solvents include, but are not limited to, alcohols such as isopropyl alcohol, ketones, phenols, carboxylic acids, and the like. By-products of the pretreatment stage, concentrated and accumulated in a recycle water stream are a readily available source of such organic compounds.

The pretreatment temperature has a large impact on the quality of coal. This effect may well be a consequence of the thermodynamics of the pretreatment reaction system that in general tends toward dehydrogenation at higher temperatures. A temperature within the range of 550° to 650° F. is critical. Within that range, a range of about 575° to 625° F. is preferred.

At a carbon monoxide treat rate of 40%, as the temperature during the pretreatment stage is increased above a certain temperature (about 600° F.), the reactivity of the coal during subsequent liquefaction begins to decrease. This is believed to occur because at these conditions, the reaction system is relatively lean in carbon monoxide, and the consumption of carbon monoxide by the shift reaction (to give $H_2$and $CO_2$) becomes more competitive with hydrogen transfer to coal at higher temperature. On the other hand, as the temperature is decreased below a certain temperature, the improvement in coal properties attributable to pretreatment begins to diminish. A catalyst/promoter allows the pretreatment reaction to proceed at a satisfactory rate at a relatively lower temperature. However, below 550° F., uncatalyzed/ unpromoted pretreatment reactions are too slow to be practical.

Although higher temperatures speed up the desired pretreatment reactions, lower temperatures prevent undesirable or retrogressive reactions. Therefore, to some extent, the reaction temperature selected is a compromise between competing effects.

An alternative embodiment is to temperature stage the pretreatment reactions by initially maintaining the temperature in the above mentioned 550° to 650° F. range for part of the time and then increasing the temperature to a range between 650° to 800° F.

The desired volatile matter content of pretreated coal can be obtained by maintaining the pretreatment temperature below about 650° F. Volatile matter is thought to be of particular importance in determining how well a particular coal will react in coal liquefaction. Concurrent measurements of other affected properties, such as coal oxygen content reduction and solubility, generally increase with increasing temperature.

Another important pretreatment process condition is carbon monoxide (CO) pressure. Higher CO pressures probably directly impact the formate ion concentration in the reaction system by shifting the reaction equilibrium to to the right as follows:

$$CO + H_2O \rightleftharpoons H^+ + HCOO^-$$

There is generally an increasing improvement in coal properties with increasing CO partial pressure ($P_{co}$). A suitable range is 500 to 1500 psi (initial) at ambient temperature, preferably about 850 to 1000 psi.

The total pressure at conditions (including $H_2O$ vapors, $CO_2$, $H_2$, CO, and $C_1$–$C_4$) is suitably in the range of about 1800 to 4500 psi, preferably about 2800 to 3400 psi, depending on $P_{co}$ and the temperature, which in turn determines the water partial pressure ($P_{H2}O$).

As mentioned above, one of the most important coal properties for predicting the reactivity of coal in liquefaction is the volatile matter content. The partial pressure of CO in the pretreatment stage has a very important effect on the volatile matter content of coal generated during the pretreatment (volatile matter is taken as the sum of the volatile content of the residue recovered after treatment in aqueous carbon monoxide and the converted material during the pretreatment itself, including $CO_2$ and chemical $H_2O$ and other light oxygenated species such as phenols, alcohols, organic acids and the like).

Generally, coal quality improves with increasing residence time in the pretreatment zone. A suitable residence time at 600° F. ranges from about 10 minutes to 5 hours, preferably, from an economic standpoint, 20 minutes to 2 hours, most preferably about 80 minutes.

Efficient mixing and good contact between the CO and coal in the pretreatment reactor is desirable. This can be accomplished with a mechanical stirrer and/or with stationary baffles that create high turbulence.

Recycle of aqueous phase compounds to the pretreatment reactor is an optional feature which can provide certain advantages. Recycle may aid in dissolution of the coal as a result of the alcohols, phenols, and carboxylic acids contained in the recycle solution. Additionally, much of the calcium and sodium based on mineral components of the coal are dissolved in the water during the pretreatment step. Separate tests showing that these compounds accelerate the desired chemistry, are explained more fully below. A recycle rate of 3:1 to 10:1 is suitable (ratio of recycle to make-up water).

Certain soluble acids or metal salts of organic acids or bases, particularly those made in the reaction system during pretreatment, all can act as promotors to enhance the pretreatment of the coal by improving coal solubility at a given temperature and pressure. The most preferred promotors are metal salts wherein the metal is in Group I or Group II of the Periodic Table, for example sodium or calcium formate. Calcium or sodium hydroxide or oxide and ammonium bisulfide or ammonium sulfide or hydrogen sulfide are also preferred.

The promotors should be present in the aqueous system in the amount by weight of 0.5 to 20%, preferably 0.5 to 10%, and most preferably 1 to 5%, except in the case of the afore-mentioned sulfides which adds little to the cost of the process, even at a much higher weight % loading.

Liquefaction. Following pretreatment, the coal is subjected to liquefaction wherein the coal is reacted with molecular hydrogen in the presence of a catalyst. The purpose is to generate a high yield of liquid products or coal oil.

The solvents employed in the liquefaction stage of the present invention are solvents which may contain anywhere from ½ to about 2 weight % donatable hydrogen, based on the weight of the total solvent. Preferred solvents include coal derived liquids such as coal vacuum gas oils (VGO) or mixtures thereof, for example, a mixture of compounds having an atmospheric boiling point ranging from about 350° F. to about 1050° F., more preferably ranging from about 650° F. to less than about 1000° F. Other suitable solvents include aromatic compounds such as alkylbenzenes, alkylnaphthalenes, alkylated polycyclic aromatics, heteroaromatics, unhydrogenated or hydrogenated creosote oil, tetralin, intermediate product streams from catalytic cracking of petroleum feedstocks, shale oil, etc. and mixtures thereof.

Preferably, the catalyst employed in the liquefaction stage is comprised of well-dispersed, submicron size particles. The catalyst may be a hydrocarbonaceous supported metal compound.

Most preferably, the catalyst is formed from a precursor which is an organic oil-soluble metal compound. The precursor is typically added to the solvent so as to form a mixture of oil soluble metal compound, solvent and coal in a mixing zone. The oil-soluble metal containing compound make-up (not including additional catalyst from recycle) is added in an amount sufficient to provide from about 10 to less than 5000 wppm, preferably from about 25 to 950 wppm, more preferably, from about 50 to 700 wppm, most preferably from about 50 to 400 wppm, of the oil-soluble metal compound, calculated as the elemental metal, based on the weight of coal in the mixture. Catalyst make-up rates are suitably from about 30 ppm to 500 ppm on coal. The remainder will normally be supplied from recycling the unconverted coal or bottoms, which contain active catalyst.

Suitable oil-soluble metal compounds convertible to active catalysts under process conditions include (1) inorganic metal compounds such as halides, oxyhalides, hydrated oxides, heteropoly acids (e.g., phosphomolybdic acid, molybdosilicic acid); (2) metal salts of organic acids such as acyclic and alicyclic aliphatic carboxylic acids containing two or more carbon atoms (e.g., naphthenic acids); aromatic carboxylic acids (e.g., toluic acid); sulfonic acids (e.g., toluenesulfonic acid); sulfinic acids; mercaptans, xanthic acid; phenols, di- and polyhydroxy aromatic compounds; (3) organometallic compounds such as metal chelates (e.g., with 1,3-diketones, ethylene diamine, ethylene diamine tetraacetic acid, etc.); (4) metal salts of organic amines such as aliphatic amines, aromatic amines, and quaternary ammonium compounds.

The metal constituent of the oil soluble metal compound is selected from the group consisting of Groups VA, VIA, VIIA and VIIIA of the Periodic Table of the Elements, and mixtures thereof, in accordance with the Table published by Sargent-Welch Scientific Company, copyright 1980, that is, vanadium, niobium, tantalum, chromium, molybdenum, tungsten, manganese, rhenium, iron, cobalt, nickel and the noble metals including platinum, iridium, palladium, osmium, ruthenium and rhodium. The preferred metal constituent of the oil soluble metal compound is selected from the group consisting of molybdenum, vanadium and chromium. More preferably, the metal constituent of the oil soluble metal compound is selected from the group consisting of molybdenum and chromium. Most preferably, the metal constituent of the oil soluble metal compound is molybdenum. Preferred compounds of the metals include the salts of acyclic (straight or branched chain) aliphatic carboxylic acids, salts of alicyclic aliphatic carboxylic acids, heteropolyacids, hydrated oxides, carbonyls, phenolates and organic amine salts. More preferred types of metal compounds are the heteropolyacids, e.g., phosphomolybdic acid (PMA). Another preferred metal compound is a salt of an alicyclic aliphatic carboxylic acid such as a metal naphthenate. Preferred compounds are molybdenum naphthenate, vanadium naphthenate, chromium naphthenate, and molybdenum or nickel-dibutyl dithiocarbamates.

The preferred catalyst particles, containing a metal sulfide in a carbonaceous matrix formed within the process, are uniformly dispersed throughout the feed. Because of their small size, typically about 1 μm in average diameter, there are typically several orders of magnitude more of these catalyst particles per cubic centimeter of oil than is possible in an expanded or fixed bed of conventional catalyst particles. The high degree of catalyst dispersion and ready access to active catalyst sites affords good reactivity control of the reactions.

Since the catalyst is effective in weight parts per million quantities of metal on feed, it is economically feasible to use them on a once through basis, although some recycle is preferred.

Various methods can be used to convert a catalyst precursor, in the coal-solvent slurry, to an active catalyst. It is usually better to form the catalyst in-situ in order to obtain better dispersion. A preferred method of forming the catalyst from the precursor or oil-soluble metal compound is to heat in a premixing unit prior to the liquefaction reaction, the mixture of metal compound, coal and solvent to a temperature ranging from about 600° F. to about 820° F. and at a pressure ranging from about 500 to about 5000 psig, in the presence of a hydrogen-containing gas. If the precursor does not have sulfur, a sulfur-containing reagent such as $H_2S$, $CS_2$ (liquid), or elemental sulfur may be introduced. The hydrogen-containing gas may be pure hydrogen but will generally be a hydrogen stream containing some other gaseous contaminants, for example, the hydrogen-containing effluent produced in a reforming process.

Preferably the hydrogen-containing gas also comprises a source of sulfur such as hydrogen sulfide. The hydrogen sulfide may suitably comprise from about ½ to about 10 mole % of the hydrogen-containing gas mixture. Hydrogen sulfide may be mixed with hydrogen gas in an inlet pipe and heated up to reaction temperature in a preheater. High sulfur coals may not require an additional source of sulfur. The catalyst precursor treatment is suitably conducted for a period ranging from about 5 minutes to about 2 hours, preferably for a period ranging from about 10 minutes to about 1 hour, depending on the composition of the coal and the specific catalyst precursor used. Such a thermal treatment in the presence of hydrogen or in the presence of hydrogen and hydrogen sulfide converts the metal compound to the corresponding metal containing active catalyst which acts also as a coking inhibitor.

Another method of converting a catalyst precursor or oil-soluble metal compound to a catalyst for use in the present process is to react the mixture of metal compound, coal and solvent with a hydrogen-containing gas in the liquefaction zone itself at coal liquefaction conditions.

Although the oil-soluble metal compound (catalyst precursor) is preferably added to a solvent, and the catalyst formed in-situ within the slurry of coal and solvent, it is also possible to add already formed catalyst to the solvent, although as mentioned above, the dispersion may not be as good.

In any case, a mixture of catalyst, solvent, and coal occurs in the coal liquefaction zone which will now be described. The coal liquefaction zone is maintained at a temperature ranging from about 650° to 950° F., preferably from about 650° to 850° F., more preferably between about 750° and 800° F., and a hydrogen partial pressure ranging from about 500 psig to about 5000 psig, preferably from about 1200 to about 3000 psig. The space velocity, defined as the volume of the coal and solvent feedstock per hour per volume of reactor (V/H/V), may vary widely depending on the desired conversion level. Suitable space velocities may range broadly from about 0.1 to 10 volume feed per hour per volume of reactor, preferably from about 0.25 to 6 V/H/V, more preferably from about 0.5 to 2 V/H/V.

With bottoms recycle, a suitable solvent:coal:bottoms ratio by weight to the liquefaction zone will be within the range of about 2.5:1:0 to about 0.6:1:2. Reducing the solvent to solids ratio improves the thermal efficiency of the process because the reactor size is reduced for a given coal throughput, or allows for more throughput. Reducing the bottoms-to-coal ratio is another option. Also when a heavier solvent is recycled at a lower solvent to solids ratio, less heat energy is required because less solvent is distilled during subsequent fractionation. A typical process solvent boiling range is from 450° to 650° F. IBP to about 1000° F. FBP.

The range of process conditions recommended for the liquefaction stage, according to an embodiment considered the best mode, is summarized in Table 1 below:

TABLE 1

| Variable | Broad Range | Preferred Range |
|---|---|---|
| Liquefaction Temperature, °F. | 650–950 | 650–800 |
| Pressure, psig | 1500–3000 | 2500–3000 |
| Slurry, Residence Time, Min | 25–480 | 60–240 |
| Solvent/Coal Ratio, by wt | 0.6–2.5 | 0.8–1.2 |
| Bottoms/Coal Ratio, by wt | 2–2 | 0.5–1.5 |
| $H_2$ treat, wt % on coal | 4–12 | 5–9 |
| Sulfur on Coal, wt % | 0–10 | 0–4 |
| Solvent Boiling Range, °F. | 450–1000 | 650–1000 |
| Catalyst Metal on coal, wppm | 100–5000 | 300–1000 |

A conversion of 50 to 80% to various products based on wt% daf coal is achieved. Normally, low liquefaction temperature results in low coal reactivity, for example, in one run at low temperature (700° F./8 hour) the liquid yield was significantly below another run at higher temperature (840° F./1 hour) with identical 1000 ppm loadings of molybdenum catalyst. However, liquefaction reactivity which allows good conversion and good liquids selectivity can be achieved at lower temperatures when the coal is first pretreated in the above described aqueous carbon monoxide environment.

As indicated as indicated in Table 2 below, the overall conversion of coal can be maintained at 700° F./8 hr when the coal is first treated in an aqueous carbon monoxide containing environment. Because $C_1$–C4 gas make is lower at low temperature, liquid yield and selectivity are higher. Although conversion is about equal, there is about ⅓ the gas make.

TABLE 2

Low Temperature Liquefaction Maintained with Lower Gas Make and Higher Liquids Selectivity From Pretreated (Aq/CO) Rawhide Coal

| | Low Temp 700° F./8 hours 1:1 Solvent:Coal 152/708 ppm Ni/Mo | Base Case 840° F./60 min 1:1 Solvent:Coal 1000 ppm Mo |
|---|---|---|
| $C_1$–$C_4$ (DAF wt %) | 2.09 | 7.53 |
| Total Cycylohexane Soluble** Liquid + Gas (DAF wt %) | 58.5* | 58.2 |

*The weighted sum of Aqueous/CO and low temperature liquefaction conversions was 58.5 wt % (DAF untreated coal). The conversion in Aqueous/CO treatment, obtained by difference of the coal charged and the solids isolated, was 17.04 wt % (DAF untreated coal). This includes hydrocarbons, water and gas ($C_4$—, $CO_x$, $H_2S$, $NH_3$). These materials are also part of the overall conversion in the base case.
**Cyclohexane soluble products are nominally 1000° F⁻.

The process of the invention may be conducted either as a batch or as a continuous type process. Suitably, there are on-site upgrading units to obtain finished products, for example transportation fuels.

DESCRIPTION OF THE DRAWINGS

Referring now to FIG. 1, pulverized coal is introduced by line 1 into a mixing and pretreatment zone 3 wherein the coal is mixed with water and carbon monoxide introduced by lines 5 and 6, respectively. This coal mixture is subjected to elevated temperature and pressure conditions as described heretofore. The gases remaining or produced in the pretreatment zone, typically $CO_2$, CO, $H_2O$, $H_2$ and $C_1$–$C_4$hydrocarbons, are removed via line 15.

Following pretreatment, the coal can be suitably dewatered in a conventional slurry or settler dewatering system, followed by a standard gravity filter belt press or the like which squeezes bulk water from the coal material. Water is shown removed from the pretreatment zone in FIG. 1 by line 13. Typically, the water content of the coal mixture is reduced to the equilibrium moisture content of 8 to 10% plus free water of about 10%. Most of the remaining water can be removed in a slurry drier 4, wherein the coal material with absorbed moisture is mixed with hot solvent. Typically, the coal is dried to about 0.5 wt% before liquefaction. On the other hand, the coal which is sent via line 14 to the partial oxidation unit, described below, is typically sent directly from the filter press, without further drying.

Figure 2:
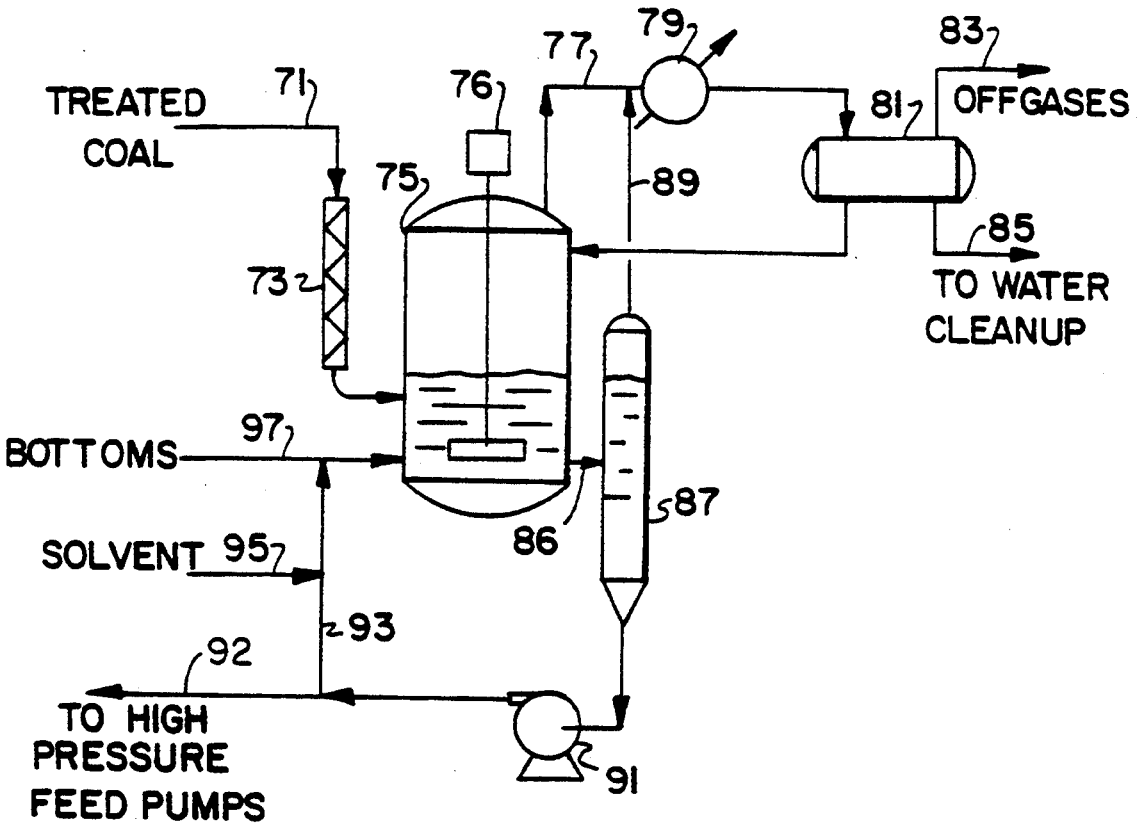
FIG. 2 shows a process flow diagram illustrating a means for dewatering of the coal mixture formed during pretreatment.

FIG. 2 illustrates a slurry dewatering system. The pretreated coal feed is introduced via line 71 through screw feeder 73 for introducing the coal into a slurry drier 75. A mixer 76 gently mixes the coal mixture while allowing off gases and water vapor to escape via overhead line 77. The overhead vapors are cooled in condenser 79 and water is accumulated in collector 81. The off gases in line 83 are treated in an environmentally acceptable manner to remove pollutants. The water stream 85 is sent for cleanup and recycle to the pretreatment zone and/or purge. The bottoms from slurry drier 75 are removed via line 86 and passed to a vessel 87 where they are collected, while allowing further escape of off gases and water vapor via line 89. The dewatered and degassed coal is then sent via pump 91 to high pressure feed pumps for further processing. A portion of the coal leaving the slurry drier may be recycled via line 93, and make-up solvent is optionally introduced via line 95. The dewatered coal in line 92 may be sent to a filter press for further dewatering. Additional bottoms from downstream may be introduced via line 97.

Figure 3:
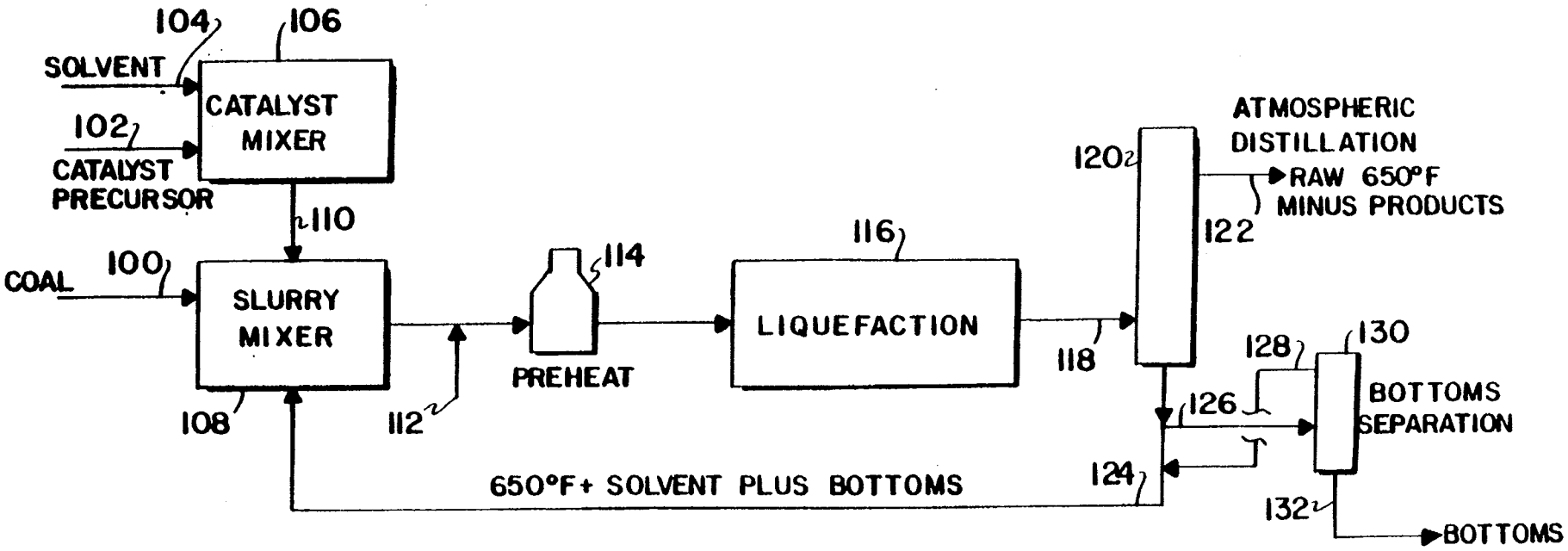
FIG. 3 shows a process flow diagram illustrating fractionation of a liquid effluent from a hydroconversion reactor.

Referring to FIG. 1, following pretreatment and dewatering, the coal enters a mixing zone 17 (analogously in FIG. 3, the coal in line 100 enters the slurry mixer 108) wherein recycled solvent is added by line 19 (124 in FIG. 3) to the coal. Optionally, recycled bottoms and solvent from downstream can be introduced via line 21 (128 in FIG. 3). A catalyst precursor containing solvent is introduced into the mixing zone 17 via line 23. In FIG. 3, a solvent stream 104 and catalyst precursor 102 are introduced into a catalyst preparation zone 106. The components in the mixing zone are intimately mixed to form a homogenous slurry. The temperature is suitably maintained at 200° to 300° F.

The mixture of oil-soluble metal catalyst precursor, solvent, and coal is introduced into catalyst activating zone 17 which may exist separately as in vessel 114 as shown in FIG. 3. A gaseous mixture comprising hydrogen and hydrogen sulfide is introduced to this zone via line 112. The catalyst activating zone is suitably maintained at temperatures ranging from about 600°–700° F. and pressures of about 2000–2500 psi. The catalyst activation is typically conducted for a period of time ranging from about 10 minutes to about 1 hour. A portion of the hydrogen sulfide may be removed from the activation zone effluent.

The coal and catalyst slurry are then introduced into a liquefaction zone 29 (or 116 in FIG. 3). The liquefaction reactor may be any suitable vessel or reactor capable of withstanding the desired temperature and pressure liquefaction conditions. Typically, there are a plurality of staged liquefaction reactors (not shown), the conditions of each reaction zone being set to maximize desired equilibrium limits and kinetic rates and to obtain the best profile of products.

A hydrogen-containing gas is introduced directly into the liquefaction reactor 29 via line 31. The hydrogen-containing gas may be pure hydrogen, but will generally be a hydrogen stream containing some other gaseous contaminants, for example, the hydrogen-containing effluent produced in reforming. Suitable hydrogen-containing gas mixtures for introduction into the liquefaction zone include raw synthesis gas, that is, a gas containing hydrogen and from about 5 to about 50, preferably from about 10 to 30 mole% carbon monoxide. Another suitable hydrogen containing gas is obtainable from the steam reforming of natural gas. Pure hydrogen if available is also suitable.

Preferably, hydrogen is provided by a partial oxidation unit 33. A suitable partial oxidation process is disclosed by Texaco in U.S. Pat. No. 3,715,301. In that process, molten coal bottoms are pumped into a partial oxidation reactor, essentially a gasifier, in the form of small droplets, where it is mixed with oxygen (for example, from an oxygen plant). The amount of oxygen is adjusted so that oxidation of the coal material all the way to $CO_2$ does not occur. Instead, the following reactions occur:

$$2C+O_2 \rightarrow 2CO$$

$$C+H_2O \rightarrow CO+H_2$$

The mixture of CO and $H_2$ produced, known as "synthesis gas", can be sent to a separation device, for example, a PRISM membrane unit 41 (registered trademark of Monsanto Corporation) following acid gas removal in separator 35 where $H_2$ is removed as a by-product via line 43 and the CO in line 6 is used for the pretreatment step. In addition, some of the gases from the partial oxidation unit can be passed over a Ni catalyst and contacted with additional water in reactor 39 to purge CO and produce $CO_2$ and $H_2$ according to the following water gas shift reaction:

$$CO + H_2O \rightleftharpoons CO_2 + H_2$$

Following acid gas removal in separator 37, $H_2$ is obtained in line 47. The hydrogen in lines 43 and 47 can be used in the liquefaction reaction zone.

It is noted in FIG. 1 that there are two partial oxidation units. The first (shown on the left and labeled coal POX) may be referred to as "slurry partial oxidation", wherein the coal is basically in solid form. The second (shown on the right and labeled VB POX) may be referred to as "molten liquid vacuum bottoms partial oxidation". Typically the weight ratio between the feeds to the first and second partial oxidation units is 50 to 35. Advantageously, the slurry partial oxidation unit, according to the present integrated process, operates on coal having a reduced equilibrium moisture content due to the coal dewatering and deoxygenating effect of the pretreatment stage. For example, instead of 50 weight % solids characteristic of low rank coal feeds, it is possible to have about 60% weight solids in the feed to the slurry partial oxidation unit, preferably about 65%. (Of course, to some extent this advantage must be balanced against investment costs, operating costs, and waste water treating costs of the pretreatment unit). The biggest benefit will be for lower rank coals. Since there is less water for a given amount of coal in the partial oxidation reactor, significantly less coal is required to provide the heat (about 2500° F.) required for gasification (water consumes much energy due to its high latent heat of vaporization) and the coal can be slurried at a higher solids concentration for partial oxidation, thereby increasing the thermal efficiency. Accordingly, improving the efficiency of moisture removal from low rank coals can have a significant impact on the overall economics of processing the coal.

Returning to the liquefaction zone 29 in FIG. 1, the effluent in line 49 comprises gases, an oil product and a solid residue. The effluent is passed to a separation zone 51 from which gases are removed overhead by line 53. The gases typically comprise $C_1$–$C_4$ hydrocarbons, $H_2$, and acid gases. The $C_1$–$C_4$ gases may be used as fuel, for example to preheat the coal. The $H_2$ may be recycled to the coal liquefaction zone via line 31 or used for upgrading the liquid products. The gases may be first scrubbed by conventional methods to remove any undesired amounts of hydrogen sulfide and carbon dioxide.

The solids component of the liquefaction effluent may be separated from the oil product by conventional means, for example, by settling, centrifuging or filtration of the oil-solids slurry. Preferably a fractionator or vacuum separator 59 is utilized to separate solvent and bottoms in line 55. If desired, at least a portion of the separated solids or solids concentrate may be recycled directly to the coal liquefaction zone or recycled to the coal-solvent chargestock via line 21. The remaining portion of solids may be discarded in an environmentally acceptable manner or combusted for producing steam. However, it is advantageous to send it as raw material to the partial oxidation unit 33, where it can be used to produce $H_2$ for lines 43 and 47, as described above and CO for the pretreatment step via line 6.

The hydrocarbonaceous oil produced in the liquefaction zone is removed from separation zone 51 by line 57 and passed to fractionation zone 61 wherein various boiling range fractions can be obtained, for example a heavy fraction, an intermediate fraction, and a light fraction. These fractions can be sent to an upgrading zone 63, where treatment with hydrogen in line 65, optionally in the presence of conventional catalysts, yields final products in line 67. In a preferred embodiment of the present invention, at least a portion of the oil product, which includes the recovered solvent, is recycled via vacuum separator 59 and line 19, into mixing zone 17 or directly into the coal liquefaction zone 29.

Various process options for treating the liquid effluent which is removed from the coal liquefaction reactor 29 are possible and will be recognized by those skilled in the art.

For example, referring to FIG. 3, a preferred embodiment is shown for treating the liquid products. The liquid effluent 118 from liquefaction reactor 116 is fractionated in an atmospheric fractionator 120 into raw 650° F. products in line 122. A portion of the atmospheric bottoms is recycled in recycle stream 124 in the desired ratio with coal and catalyst. The atmospheric bottoms not required for recycle to liquefaction are routed in line 126 to a bottoms separator 130 to recover additional 650° F.+ liquids in line 128 for use as solvent. This separator 130 may be a vacuum distillation tower, solvent extraction unit, etc. The residual vacuum bottoms in line 132 can be utilized as feed, separately or blended with coal, to a partial oxidation unit, a hybrid boiler, or a conventional boiler for process heat or hydrogen.

The recycle atmospheric bottoms stream contains active, well-dispersed microcatalyst. Make-up catalyst is needed to maintain catalyst concentration due to loss of catalyst purged with the bottoms.

In another embodiment, a fractionator following the coal liquefaction zone may be used to separate the effluent into a light liquid or naphtha, $C_5$ to 400° F. (400−), a distillate at 400°–650° F. and a solvent at 650°–1000° F. The solvent is preferably recycled to the liquefaction reactor and the bottoms from the fractionator can be recycled to the liquefaction reactor and/or purged.

The following examples illustrate certain preferred embodiments and advantages of the present process. The examples are not intended to limit the broad scope of the the present invention. Other advantages and embodiments of the present invention will be apparent to those skilled in the art from the description provided herein.

EXAMPLE 1

This example illustrates a combined pretreatment and liquefaction process with a lignite feed. Troup lignite (23% moisture) is reacted in $H_2O$/CO at 650° F for 1 hour at a total pressure of 4400 psi. The total daf conversion is about 22%, including 12% $CO_x$ (mostly $CO_2$), 0.24% $C_1$-$C_3$ gas, 0.28% $H_2S$, and 9.5% water plus hydrocarbonaceous liquids (mostly water). As shown in Table 3 below, the oxygen and moisture contents are substantially decreased during the treatment, the H/C ratio is increased as hydrogen is transferred into the products from water, and 40% of the organics are converted to preasphaltenes. The properties of the pretreated coal are as follows:

TABLE 3

| Coal Properties | Raw Troup | $H_2O$/CO Treated |
|---|---|---|
| H/C | 0.85 | 0.91 |
| O/C | 0.23 | 0.13 |
| Asphaltenes & Preasphaltenes, wt % DAF | 0.4 | 42.5 |
| Eq. Moisture (g $H_2O$/g dry coal) | 0.42 | 0.17 |

The solid product is then themally dried and reacted under liquefaction conditions in once-through tubing bomb experiments for reaction times between 30 and 120 minutes. The conditions are 800° F., solvent/coal 1.6/1, 60%/40% mixture of decalin/tetralin solvent with DH 1.2, $H_2$ treat 6%, and 1000 ppm Mo as MoDTC (molybdenum dibutyl dithiocarbamate). The pretreated coal reacts more quickly in liquefaction than the raw coal. Although at 2 hours reaction time in liquefaction the pretreated coal only reaches a combined conversion about 3% higher than that of the raw coal, it requires <1 hour reaction time to reach this conversion. Consequently, one hour in $H_2O$/CO followed by one hour in liquefaction gives about 3% higher conversion but more importantly ~8% more liquids with 1% less hydrogen consumption than 2 hours in liquefaction alone. A large part of this difference is due to a reduction in the amount of $C_1$–$C_3$ gas produced during the shorter reaction time in liquefaction.

The aqueous pretreatment step has been effective in increasing the reactivity and conversion of a range of feeds including peats, brown coals, lignites, sub-bituminous and bituminous coals. Advantages of the aqueous pretreatment stage in combination with the disclosed liquefaction stage have also been demonstrated for Rawhide coal as shown in Table 4.

TABLE 4

Conversion of Rawhide Coal[a]

| | Aqueous Pretreatment | Liquefaction 1 Hr 1800° F./1000 ppm Mo/1 Hour[b] $H_2O$/CO Pretreated | Raw |
|---|---|---|---|
| Wt % DAF Coal: | | | |
| Total Conversion | 20 | 60 | 50 |
| $CO_x$ | 12 | 14.2 | 15.1 |
| $C_1$–$C_3$ | 0.33 | 4.27 | 5.58 |
| $H_2S$ | 0 | 0.1 | 0.1 |
| Liquids + Water | 7.7 | 42.7 | 30.5 |
| $H_2$ Consumption | — | −1.3 | −1.42 |

Note:
[a]Rawhide, a sub-bituminous coal from Wyoming, is a potentially attractive synfuels feedstock because it is a low sulfur and ash, low cost coal which can be surface mined. Unfortunately, it is debited by its high moisture and oxygen levels. The aqueous/CO pretreatment provides a route for efficiently reducing the oxygen and moisture contents while improving reactivity.
[b]1.6:1 solvent-to-coal with donor hydrogen level of 1.2%.

EXAMPLE 2

This example illustrates the effect and advantages of an aqueous carbon monoxide pretreatment over 3 control treatments, namely (1) none, (2) decalin and $N_2$, and (3) $H_2O$ and $N_2$. Rawhide coal with as received moisture levels of 27–33% was stored under $N_2$ in sealed glass jars. Analysis of the raw coal is given in Table 5.

TABLE 5

Analysis of Rawhide Coal

| MOISTURE (as received) Wt % | ASH Wt % Dry | VOLATILE MATTER | O | S | C | H | N |
|---|---|---|---|---|---|---|---|
| | | | Wt % daf Caol | | | | |
| 33 | 5.8 | 47.6 | 20.85 | 0.22 | 73.11 | 4.8 | 1.03 |

For the aqueous experiments, the coal was ground quickly in a mill to −30 mesh and resealed in glass jars to minimize moisture loss. Both raw and treated coal for the liquefaction experiments were dried overnight in a vacuum oven at 230° F. and ground to 30×100 mesh.

The aqueous pretreatments and the liquefaction experiments were performed in tubing bomb reactors in a fluidized sand bath. The reactors used for the pretreatment experiments were constructed from 1 inch 316 stainless steel pipe and had approximate volumes of 70 cc. These reactors could be operated at pressures as high as 4500 psi at temperatures up to 700° F. In the experiments, 6 g of wet Rawhide coal (moisture 27–33%) was charged into the reactor with 12 g of deoxygenated, deionized water or decalin, depending on the experiment. The reactors were connected to a gas manifold where they were purged and charged with CO or $N_2$. The pressure was measured by a pressure transducer. Six tubing bombs could be charged and reacted simultaneously.

The charged reactors were wired to a rack and submerged in a fluidized sand bath where they were agitated at a rate of 200 cycles per minute. They reached reaction temperature within 5 minutes. In order to assure that the temperature was uniform for all of the reactors, thermocouples were periodically attached to bombs at different points on the rack. Temperatures did not generally vary more than 2° F. between the bombs. As an added precaution, however, duplicate bombs were positioned at different levels on the rack to pick up any unexpected temperature gradients. At the end of the desired reaction period, the bombs were removed from the sand bath and allowed to cool in air for 10 minutes before being quenched in a water bath.

The gas from each cooled bomb was discharged through an empty glass gas displacement bomb (250 or 500 cc) into a water displacement system where the volume was measured. After about half of the gas had been discharged, the gas bomb was isolated and removed from the system. This was then submitted for GC analysis. Operating the system in this way prevented contact of the GC samples with the water in the gas displacement system. In addition, collecting the GC sample halfway through the gas discharge minimized the effects of selective diffusion of the lighter gases.

The bombs were then opened, and the water was decanted into a vial, taking care not to lose any solid material. The solids were washed into a 50 cc centrifuge tube with deionized water. The bombs were repeatedly scraped and washed with deionized water until all of the solids were removed. The bombs were dried in a vacuum oven and reweighed. They were then washed with MEK to remove any residual solids, redried, and reweighed. Weight loss during the MEK wash was used to estimate unrecovered solids. This was generally below 0.1 g. The centrifuge tubes containing the recovered solids were centrifuged for 15 minutes. The water was decanted and filtered through a tared #2 filter to collect any particles floating on the water layer. The solids in the centrifuge tube and the filter paper were dried overnight in a vacuum oven at 230° F., and the dried solids from the filter paper (usually <0.05 g) were added to the solids in the centrifuge tube. These procedures allowed calculation of overall conversion and gas yields. Liquid and water products were then determined by difference.

To measure the tetrahydrofuran (THF) solubility of the treated coal, the dried solid products were finely ground and 1–2 g was weighed into a 50 cc centrifuge tube. The tube was filled with unstabilized THF, stirred at room temperature for 2 minutes, and centrifuged for 10 minutes. The THF was then decanted and saved. This procedure was repeated 4 or 5 times, or until the decanted THF was clear. The solids (THF insolubles) were dried as before. To collect the THF solubles, the THF was weathered off under a $N_2$ purge and the solids were dried in a vacuum oven.

The liquefaction experiments were performed in standard tubing bombs constructed of ¾" 316 stainless steel tubing having volumes of about 37 cc. The reactors were charged with 3.0 g of dried coal, 4.8 g of a 60/40 decalin/tetralin mixture (DH=1.2), and 0.017 g of MoDTC. This gave a Mo loading on dry coal of 1000 ppm. The bombs were charged with 1000 psi of $H_2$ and reacted in the fluidized sand bath at 800° F. The bombs were removed and cooled, and the gases were collected and measured as described earlier. The solids were scraped and washed from each bomb into centrifuge tubes using cyclohexane. The solids were then extracted with cyclohexane five times, using the procedure described earlier for THF. Total liquefaction conversion was calculated from the amount of cyclohexane insolubles (unconverted coal). Gas yields were calculated from the gas analyses, and liquid and water yields were determined by difference.

All tubing bomb experiments were run at least in duplicate. The data reported here represent the average of at least two bombs. For liquefaction experiments, each run included an untreated Rawhide coal base case.

The volume of each tubing bomb was measured by charging the bomb with 600 psi $N_2$ and measuring the volume of gas in the bomb using the water displacement system. Volume determinations were made in triplicate.

Wet Rawhide coal was pretreated in decalin/$N_2$, $H_2O/N_2$, and $H_2O$/CO for 2 hours at 650° F. with a gas charge of 900 psi (cold). Decalin was used as an inert solvent to slurry the coal in order to study its thermal reactions. Pressure at 650° F. was ~4400 psi for the aqueous systems, and ~2000 psi for the decalin system. Table 6 lists the conversions of the coals and compares the effects of the treatments on several important properties of the pretreated coals.

TABLE 6

Conversion of Rawhide Coal in Aqueous and Thermal Systems at 650° F.
Decalin/$N_2$ Pretreatment: Dried Caol, 650° F., 2000 pis, 2 Hours
Aqueous Pretreatments:
Wet Coal (33% Moisture), 650° F., 400 psi, 2 Hours

| | Pretreatment | | | |
|---|---|---|---|---|
| | None | Decalin/$N_2$ | $H_2O/N_2$ | $H_2O$/CO |
| Conversion (Wt % daf Coal) | | | | |
| $CO_x$ | — | ND* | 12 | 12 |
| $C_1$–$C_3$ | — | ND | 0.3 | 0.3 |
| Liquids + $H_2O$ | — | ND | 6.7 | 7.7 |
| Total Conversion | — | 6 | 19 | 20 |
| Properties Of Treated Coal (Wt % daf Coal) | | | | |
| THF Solubles | 6 | 4 | 8 | 65 |
| H/C Ratio | 0.80 | 0.72 | 0.73 | 0.91 |
| Oxygen | 20 | 16 | 13 | 11 |
| Sulfur | 0.2 | ND | 0.2 | 0.2 |
| Nitrogen | 1.0 | ND | 1.1 | 1.2 |
| Ash (% Dry) | 5.8 | ND | 6.0 | 6.0 |
| Moisture (% Coal) | 32 | ND | 12 | >9 |

*ND = not determined.

In both aqueous systems, 19–20% of the coal was converted to $CO_2$, $H_2O$, and liquids. In the thermal system, the conversion was only 6%. The aqueous/CO pretreatment increased the solubility of the coal in THF from 6% to 65%. This is an indication that a significant amount of depolymerization of the coal structure occurs during the pretreatment. This pretreatment also increased the H/C ratio of the coal from 0.8 to 0.91. About 40% of this increase is believed due to loss of carbon as $CO_2$, so about 60% must be due to hydrogenation, with water as the ultimate source of hydrogen. A hydrogen balance indicates that about 0.8 wt % hydrogen (based on raw daf coal) was transferred from the water to the coal. No evidence of depolymerization or hydrogenation of the coal was noted after the decalin/$N_2$ or $H_2O/N_2$ pretreatments at the same conditions. In these runs, the THF solubilities of the coals did not increase and the H/C ratios were reduced to 0.72 and 0.73, respectively, most likely due to the removal of coal oxygen as $H_2O$.

The depolymerization and hydrogenation of the coal in aqueous/CO enhances its reactivity for further hydroconversion or liquefaction processing. Conversely, the decrease in H/C ratio noted after the thermal and $H_2O/N_2$ pretreatments could debit liquefaction conversion.

None of the pretreatments significantly altered the ash, nitrogen, or sulfur contents of the coal. Although all of the pretreatments resulted in some loss of oxygen from the coal, the aqueous pretreatment chemistry significantly promoted oxygen removal. This was reflected both in $CO_2$ production during the pretreatment, and in the oxygen contents of the treated coals. Thermally, only 11% of the oxygen was removed, while in $H_2O/N_2$ and $H_2O$/CO, the oxygen content was reduced by 40% and 50%, respectively.

Physical and chemical changes which occur in the coal structure during the aqueous pretreatments cause the coal to lose its capacity to hold moisture. The equilibrium moisture content of the coal was reduced from 32% to 12% in the $H_2O/N_2$ pretreatment, and <9% in the $H_2O$/CO pretreatment.

These results show the advantages of the aqueous/CO pretreatment over the thermal and $H_2O/N_2$ pretreatments at the same conditions. The aqueous/CO pretreatment not only provides the highest degree of dewatering and deoxygenation, but also improves the properties of the coal which control its reactivity in further processing. The other pretreatments degrade these properties.

EXAMPLE 3

Figure 4:
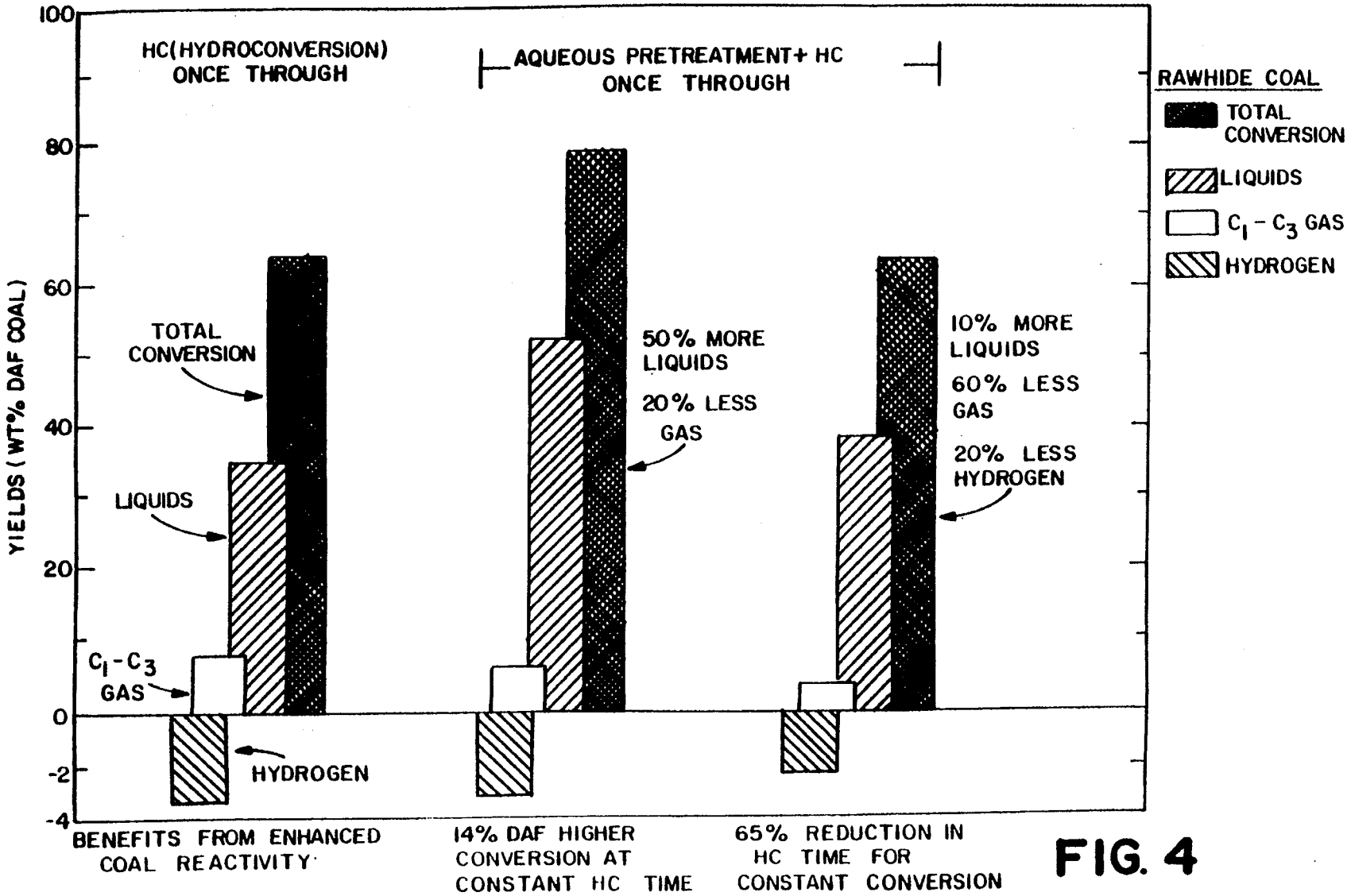
FIG. 4 is a chart showing the effect of the pretreatment of coal in improving the liquefaction product selectivity and conversion.

This example illustrates the effect of the pretreatment conditions on both conversion in the aqueous system and on the properties of the treated coal. Wet Rawhide coal was reacted in aqueous/CO for 2 hours with a CO charge of 900 psi (cold) at temperatures between 450° and 650° F. Because the vapor pressure of water increases almost exponentially in this temperature range, small changes in temperature can significantly impact the pressure of the system. FIG. 4 shows the properties of the treated coals including H/C ratio, oxygen content, volatile matter, and equilibrium moisture.

Various properties and conversions respond differently to the aqueous/CO treatment temperature. There is evidence of hydrogen transfer into the coal from the water at temperatures as low as 450° F. The production of THF solubles takes off at temperatures above about 550° F. Equilibrium moisture drops significantly at temperatures as low as 450° F. Oxygen content shows a slower decline with temperature. Conversion and some other properties appear to line out somewhat about 625° F.

The effect of CO pressure on conversion and coal properties in the aqueous/CO system at 625° F was studied. CO pressure was changed by varying the initial CO charge between 700 and 900 psi at room temperature. The measured pressure at reaction temperature varied from 3300 to 3900 psi. Over this range of pressures, essentially no changes were detected in the total con-versions to liquids+water+gas, or in the oxygen contents or H/C ratios of the treated coals. A slight increase in volatile matter was noted, but the largest variation was in the production of THF solubles which ranged from 35% to 47% over this set of conditions. The data at the lowest pressure of 3300 psi still displayed substantial improvements in all of the coal properties tested.

Reaction times between 30 minutes and 4 hours were studied in the aqueous/CO system at 625° F./3300 psi and 650° F./4400 psi in order to show the effect on conversions and coal properties. At both temperatures, conversions to liquids+water+gas showed only minor changes over this range of times, while production of THF solubles was very dependent on reaction time. For the 625° F. cases, the rate of production of THF solubles appears to increase between 1 and 2 hours, and then slow somewhat between 2 and 4 hours. Between 2 and 4 hours the yield of THF solubles still increases significantly, from 38% to 57%. At 650° F. the rate of production of THF solubles is already decreasing between 1 and 2 hours, and between 2 and 4 hours only a small increase in THF solubles is observed. At 650° F. the oxygen content of the treated coal shows only small further decreases after 1 hour in aqueous/CO, while at 625° F. it is somewhat slower in leveling off. At both temperatures, volatile matter and H/C ratio are more dependent on reaction time.

The effect of the $H_2O$/coal and CO/coal ratios on conversions and coal properties were also studied over a range of temperatures. All of the data discussed earlier were obtained at $H_2O$/daf coal weight ratios of 3.3–3.7 and at CO/daf coal weight ratios of 0.65 (700 psi CO charge) and 0.84 (900 psi CO charge). These CO/daf coal weight ratios are equivalent on a molar basis to hydrogen treats of 4.6% and 6%, respectively. The $H_2O$/coal and CO/coal ratios were varied by changing the amounts of wet coal and water charged to the reactors in order to show the effects on conversion to THF solubles and on the H/C ratios of the treated coals to temperatures of 550°, 600°, and 650° F., all at 2 hour reaction times.

At 550° F. it is possible to cut the water/daf coal ratio in the aqueous system to 1/1 and to decrease the CO treat to a 3 wt % hydrogen equivalent without significantly affecting conversion or the properties of the treated coal. Further decreases in either water or CO do have adverse effects on the properties of the treated coal. At higher temperatures, although some reductions in water and CO levels are possible, neither can be cut back as far as in the 550° F. case without losing some of the effects of the aqueous treatment. At the higher temperatures, water-gas-shift converts more of the CO to $CO_2$. (Since thermodynamically, higher temperatures should favor CO over $CO_2$, this indicates that water-gas-shift is kinetically rather than thermodynamically controlled in these experiments. This is confirmed by calculations which show that in all of these cases, water-gas-shift is far from equilibrium.) This may partly explain the higher CO requirement at higher temperatures. In addition, more water is required at higher temperatures to maintain a liquid aqueous phase in the reactor.

EXAMPLE 4

This example illustrates the effect of aqueous/CO pretreatment on increasing the reactivity of coals in liquefaction. Rawhide coal was pretreated in aqueous/CO for two hours at 650° F. and 4400 psi and then reacted in liquefaction at 800° F. for 0.5–4 hours. The results are compared to data for conversion of non-pretreated Rawhide coal in FIG. 5. For the case which includes the aqueous/CO pretreatment, yields are the combined yields in the aqueous and liquefaction stages, total reaction time includes the 2 hours in the aqueous stage, and the hydrogen consumption includes the CO (on a molar equivalent basis) consumed in the aqueous stage. After the aqueous/CO pretreatment, Rawhide coal not only reacts more quickly in the liquefaction step, but also reaches a 15 daf wt % higher conversion at long liquefaction reaction times. The increased conversion appears as liquids. Even at the highest conversion, $C_1$–$C_3$ gas yields and hydrogen consumption are reduced compared to the non-pretreated coal.

Figure 5:
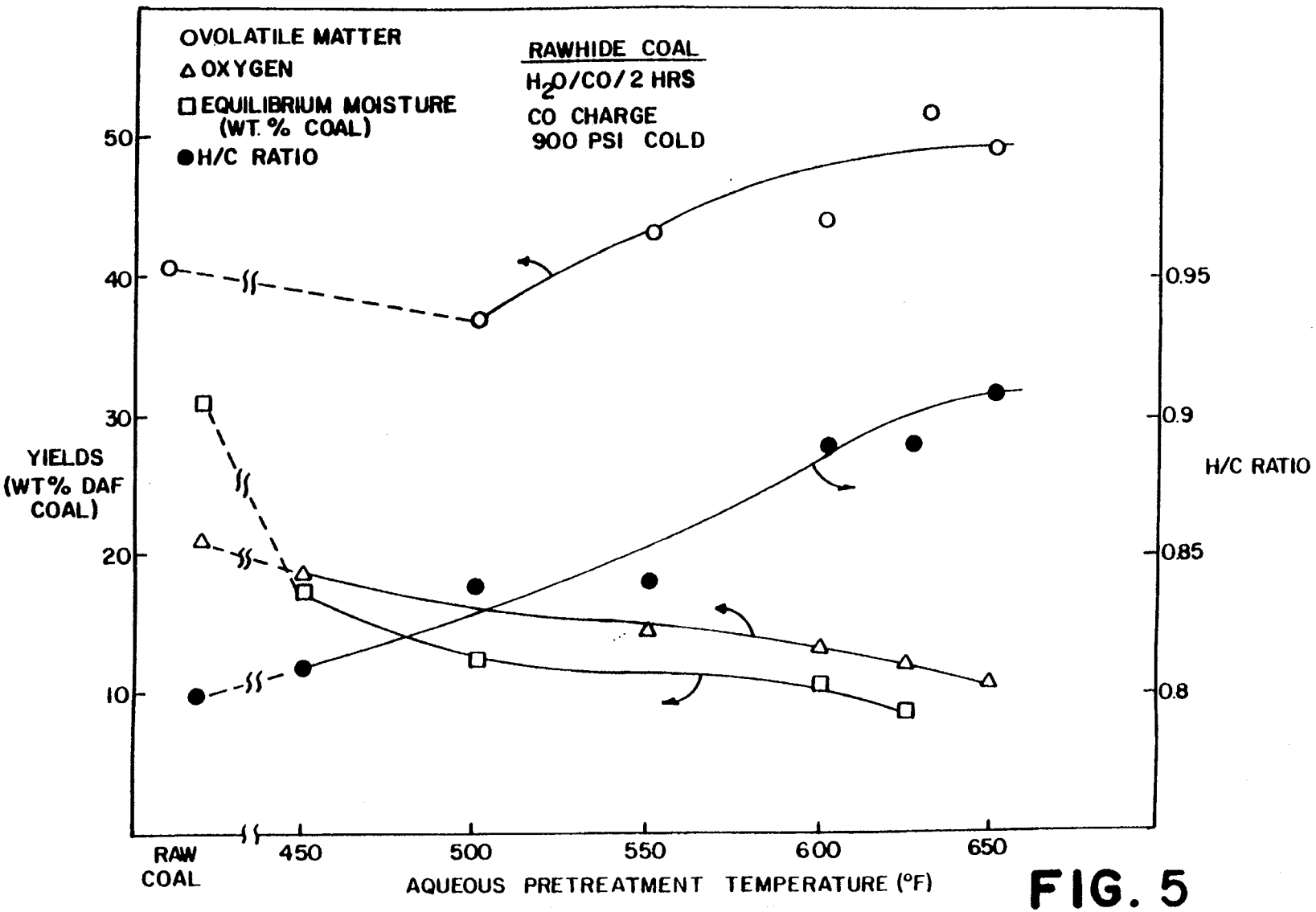
FIG. 5 is a graph showing the effect of coal pretreatment temperature on the properties of coal.
Figure 6:
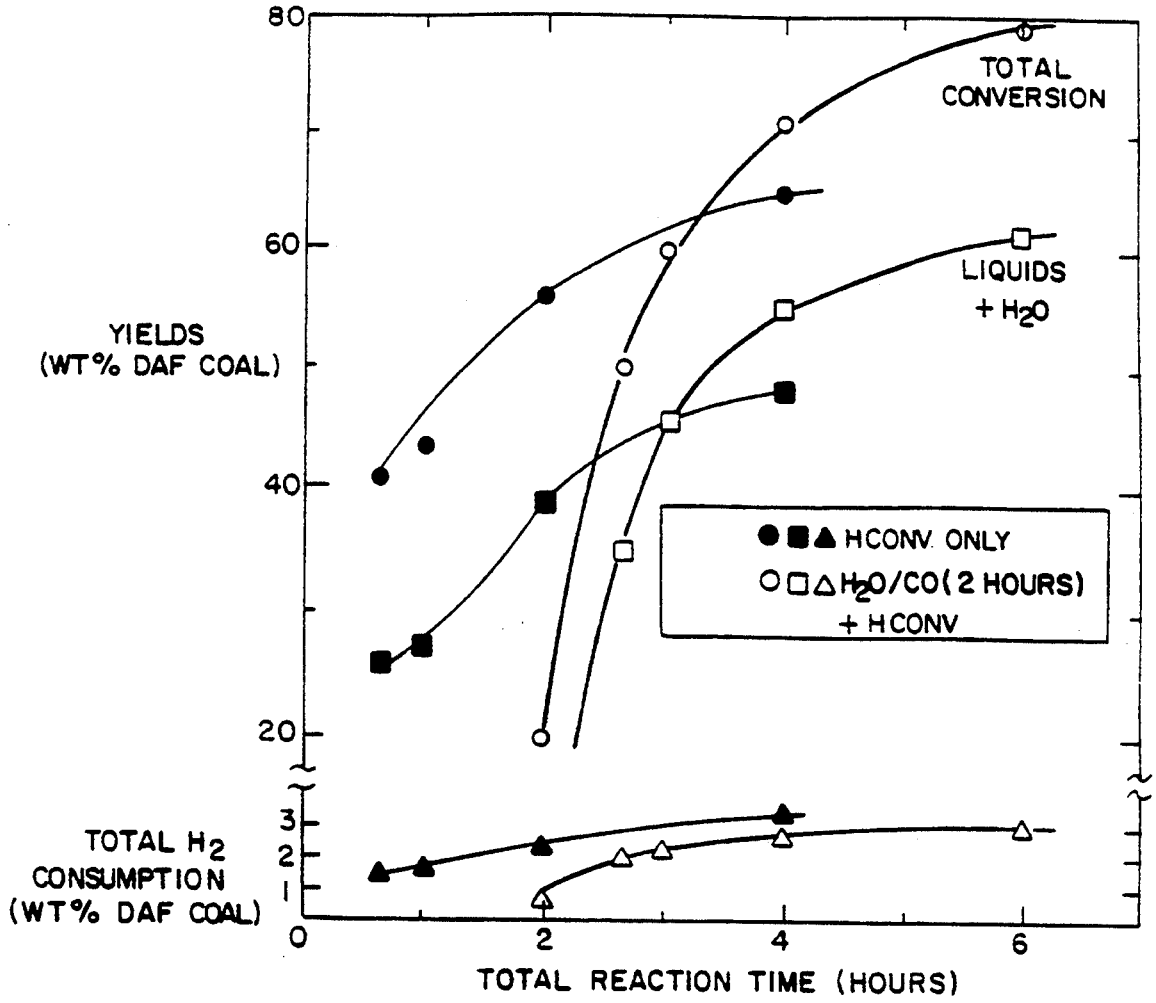
FIG. 6 is a graph showing the effect of coal pretreatment according to the present invention on liquefaction reactivity of coal.

There are several ways to take advantage of the enhanced reactivity of the aqueous/CO pretreated Rawhide coal in liquefaction- To illustrate this, some of the data from FIG. 5 are replotted as bar charts in FIG. 6. If the pretreated and non-pretreated coals are reacted for equal amounts of time in liquefaction (10 (a) and (b)), the coal can reach a 14 daf wt % higher conversion in the combined aqueous pretreatment/ liquefaction process than in liquefaction alone. This results in a 50% increase in liquid yields, while the $C_1$–$C_3$ gas make is reduced by about 20% (both on a relative basis). Even with this large increase in liquid yields, the total hydrogen consumption is slightly reduced, which indicates that the hydrogen utilization efficiency has been markedly improved.

The enhanced reactivity of the aqueous pretreated coal can also be used to improve product selectivity at constant conversion. The liquefaction reaction time for the pretreated coal can be decreased so that it reaches the same total conversion as the non-pretreated coal (10 (a) and (c)). After the aqueous pretreatment, only 35% as much reaction time in liquefaction is required for the pretreated coal to reach that conversion. Since the pretreated coal has been exposed to the more severe MCL conditions for a much shorter time, the $C_1$–$C_3$ gas make is reduced by 60%. This increases the liquid yield by 10%. Since lower H/C liquid products are being substituted for higher H/C gas products, the total hydrogen consumption is reduced by 20%. (All %'s are again expressed on a relative basis.)

EXAMPLE 5

This example illustrates the response of the aqueous/CO treated Rawhide to the liquefaction conditions. In one set of runs, the hydrogen pressure (and consequently hydrogen treat) was increases. As shown in Table 7 below, the conversions of both the untreated and aqueous/CO pretreated Rawhide were increased by 6–6.5%, preserving the conversion difference between the two cases.

TABLE 7

Effect of Hydrogen Treat and Pressure on liquefaction (L) Conversions of Untreated and Aqueous/CO Pretreated Rawhide Aqueous/CO Pretreatment: 650° F./4400 psi, 2 Hours MCL Conditions: 800° F., 2 Hours, Mo 1000 ppm, Solvent DH 1.2

| Conversion | $H_2$ 1000 psi (cold) ($H_2$ Treat 6 wt %) | | $H_2$ 1200 psi (cold) ($H_2$ Treat 7.2 wt %) | |
|---|---|---|---|---|
| (wt % daf Coal) | L | Aq/CO + L | L | Aq/CO + L |
| $CO_x$ | 14.7 | 13.9 | 11.8 | 13.7 |
| $C_1$–$C_3$ | 5.5 | 3.9 | 5.8 | 4.4 |
| Liquids + $H_2O$ | 38.0 | 55.2 | 48.3 | 61.4 |
| Total Conv | 55.8 | 70.9 | 62.3 | 76.9 |
| $H_2$ Consumption | −2.3 | −2.1 | −3.5 | −2.5 |

EXAMPLE 6

This Example illustrates the effect of the aqueous pretreatment conditions (temp., time, water/coal ratio) on the liquefaction reactivity of the pretreated coal in long residence time (4hours) once-through liquefaction experiments. The long liquefaction reaction time was chosen to best simulate bottoms recycle which provides long residence time for bottoms conversion.

Decreasing the reaction time in the aqueous/CO pretreatment stage to 1 hour at 625° F. or 650° F. significantly decreased the conversion of the coal. Further increasing the pretreatment time from 2 to 4 hours at 650° F. increases the conversion slightly.

For all of the data discussed above, water/daf coal ratios of 3.3–3.7 and CO treats of 4.6–6.0% on a hydrogen equivalent were used in the pretreatment stage. At 550° F., it was possible to decrease the water/daf coal ratio to 1/1 and to cut the CO treat in half without debiting conversion. Further reductions in CO and water, however, did begin to decrease conversion. At 600° F. and 650° F., it was not possible to cut down the water and CO charges as low as in the 550° F. case without significantly decreasing conversion. This may be due to the larger amount of water-gas-shift and the greater amount of water that is vaporized at the higher temperatures.

Figure 7:
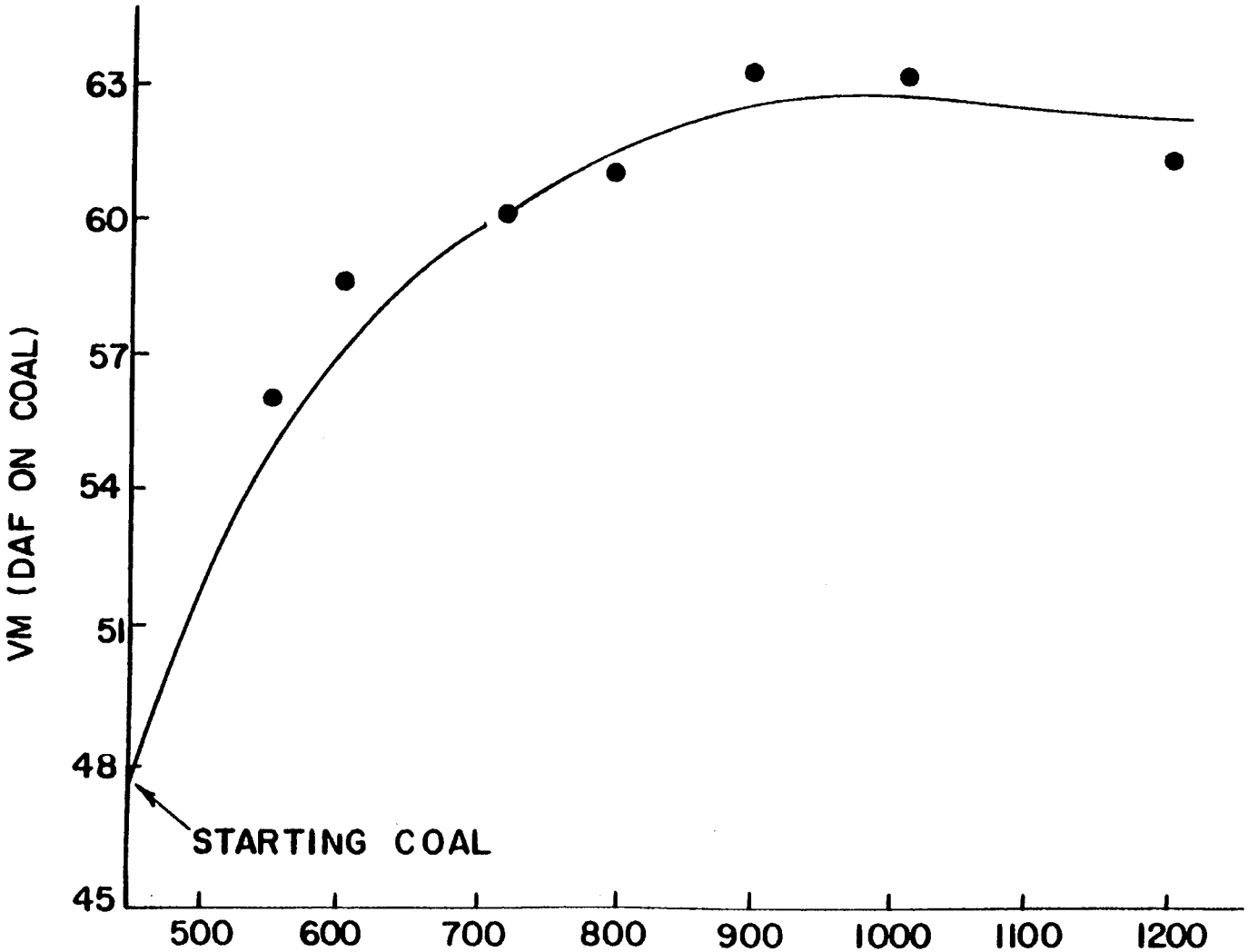
FIG. 7 shows the effect of carbon monoxide partial pressure during pretreatment on the volatile matter content of coal.

In the examples given, volatile matter (at 850° C., in nitrogen) is taken as the sum of the volatile content of the residue recovered after pretreatment in water/CO and the converted material during the pretreatment itself (mostly $CO_2$ and $H_2O$). The CO partial pressure is calculated from the total pressure and an analysis of the gases present at the end of the experiment. FIG. 7 illustrates that an increase in the final partial pressure of CO in a batch tubing bomb directly correlates with the observed improvement in total volatile matter. However the maximum quality coal is produced with a CO partial pressure of approximately 850–1000 psia.

EXAMPLE 7

This example further illustrates the effect of aqueous pretreat conditions, for example CO partial pressure, on the liquefaction reactivity of the treated coal. The CO partial pressure also influences how fast a given quality coal is produced in batch tubing bomb experiments using a water:coal ratio of 2:1, a temperature of 625° F., and Rawhide coal- As an example of how this can be used, under the conditions examined, it was found that a total product volatile matter content of 55.6% can be achieved in 2 hours at 535 psia CO, 1.2 hours at 890 psia or 0.7 hours at 1380 psia. Alternatively, the total volatile matter content can be increased from 55.6% to 57.9% or 60.7% respectively for the three pressures measured at a constant 2 hour reaction time. In summary, the aqueous/CO pretreatment of coal for subsequent liquefaction can be significantly improved by optimizing the CO partial pressures to yield an improved quality product or by trading increased CO partial pressures for a reduction in residence time.

It will be understood that while there have been herein described certain specific embodiments of the invention, it is not intended thereby to have it limited to or circumscribed by the details given, in view of the fact that the invention is susceptible to various modifications and changes which came within the spirit of the disclosure and the scope of the appended claims.

What is claimed is:

1. A process for hydroconverting coal to produce a hydrocarbonaceous liquid which comprises the steps of:

(a) pretreating the coal by forming a mixture of coal, carbon monoxide and water and subjecting the mixture to a temperature of 550° to 650° F. and a carbon monoxide partial pressure of 500 to 5000 psia for a period of at least 10 minutes to cause hydrogenation of the coal;

(b) removing gases and water from the pretreated coal mixture;

(c) forming a subsequent mixture of said pretreated coal, organic solvent, and a catalyst, wherein the catalyst is comprised of dispersed submicron size particles of a metal sulfide-containing compound, said metal being selected from the group consisting of Groups VA, VIA, VIIA, and VIIIA of the Periodic Table of the Elements and mixtures thereof, said catalyst being present in the mixture in an amount ranging from about 10 to less than 5000 weight parts per million, calculated as the elemental metal, based on the weight of coal in said mixture, and wherein the catalyst is formed in situ from an oil-soluble precursor metal compound;

(d) reacting the resulting mixture containing said catalyst under coal hydroconversion conditions at a temperature of 650° to 850° F. in the presence of hydrogen, in a hydroconversion zone; and (e) separating the contents of said hydroconversion zone into at least three fractions; (1) an effluent product comprising a hydrocarbonaceous liquid; essentially free of coal residue solids; (2) a bottoms comprising coal residue solids; and (3) a gaseous top.

2. The process of claim 1, wherein the catalyst is a conversion product of an oil-soluble organometallic compound.

3. The process of claim 2, wherein step (d) is carried out between 650° and 800° F.

4. The process of claim 2, wherein said oil-soluble metal compound is selected from the group consisting of inorganic compounds, salts of organic acids, organometallic compounds and salts of organic amines.

5. The process of claim 4, wherein said oil-soluble metal compound is selected from the group consisting of salts of acyclic aliphatic carboxylic acids and salts of alicyclic aliphatic carboxylic acids.

6. The process of claim 5, wherein said oil-soluble metal compound is a salt of naphthenic acid.

7. The process of claim 2, wherein said oil-soluble metal compound is converted to a catalyst by first heating a mixture of said soluble metal compound, coal and solvent to a temperature ranging from about 325° to about 438° C. in the presence of hydrogen-containing gas to form a catalyst within said mixture and subsequently reacting the resulting mixture containing the catalyst with hydrogen under coal liquefaction conditions.

8. The process of claim 2, wherein said oil-soluble metal compound is converted in the presence of a hydrogen-containing gas in the coal liquefaction zone under coal liquefaction conditions, thereby forming said catalyst in-situ within said mixture in said liquefaction zone.

9. The process of claim 1, wherein said catalyst particles have an average diameter of 50 to 1000 Å.

10. The process of claim 1, further comprising recycling the solvent, with or without intervening hydrogenation, to said hydroconversion zone.

11. The process of claim 1, comprising separating the effluent product of the hydroconversion zone into at least two fractions, a light fraction and a heavy fraction, and recycling the light fraction as solvent to the hydroconversion zone.

12. The process of claim 11, wherein at least a portion of the pretreated coal bypasses hydroconversion and is subjected to partial oxidation.

13. The process of claim 11, wherein the water-to-coal ratio, excluding the same, is greater than about 1.0:1.

14. The process of claim 1, wherein the coal is raw pulverized coal.

15. The process of claim 1, wherein at least a portion of the bottoms is subjected to partial oxidation, whereby carbon monoxide for step (a) is produced and hydrogen for step (d) is produced.

16. The process of claim 1, comprising the additional steps of separating at least a portion of said bottoms from said hydroconversion zone and recycling said portion to said hydroconversion zone.

17. The process of claim 1, wherein the top is a gaseous mixture comprising hydrogen, and wherein, in a separation zone, the gases are removed overhead and hydrogen is thereafter recycled to the hydroconversion zone.

18. The process of claim 1, wherein the coal residue solids are less than 10% by weight of the original coal feed.

19. The process of claim 1, wherein following step (a), water is separated from the coal mixture by settling, centrifuging or filtering.

20. The process of claim 1, further comprising introducing the hydrocarbonaceous liquid into a fractionation zone, wherein at least two fractions are obtained and whereby at least one fraction is recycled to the liquefaction zone.

21. The process of claim 1, wherein the water-to-coal ratio is at least about 0.5:1.

22. The process of claim 1, wherein the partial pressure of CO is about 800 to 4500 psi.

23. The process of claim 1, wherein the residence time in the hydroconversion reactor is about 20 minutes to 2 hours.

24. The process of claim 1, wherein the coal is subbituminous, lignite, brown or peat.

25. The process of claim 1, wherein the coal is subbituminous coal.

26. The process of claim 25, wherein said oil-soluble metal compound is molybdenum naphthenate.

27. The process of claim 25, wherein said oil-soluble metal compound is phosphomolybdic acid.

28. The process of claim 1, wherein the metal constituent of said oil-soluble metal compound is selected from the group consisting of molybdenum, chromium and vanadium.

29. The process of claim 1, wherein said hydrogen-containing gas of step (d) comprises from about 1 to 10 mole % hydrogen sulfide.

30. The process of claim 1, wherein said hydrogen-containing gas of setp (d) comprises from about 1 to 5 mole % hydrogen sulfide.

31. The process of claim 1, wherein said coal hydroconversion conditions in step (d) further include a hydrogen partial pressure ranging from 500 to 5000 psig.

32. The process of claim 1, wherein the space velocity of said mixture in said hydroconversion zone ranges from about 0.1 to 10 volumes of mixture per hour per volume of hydroconversion zone.

33. The process of claim 1, wherein said solvent and coal are mixed in step (c) in a solvent-to-coal weight ratio ranging from about 0.8:1 to about 4:1.

34. The process claim 1, wherein said solvent and coal are mixed in step (c) in a solvent-to-coal weight ratio ranging from about 1:1 to 2:1.

35. A process for hydroconverting coal to produce a hydrocarbonaceous liquid which comprises the steps of:

(a) pretreating the coal by forming a mixture of coal, carbon monoxide and water and subjecting the mixture to a temperature and pressure effective to cause hydrogenation of the coal;

(b) removing gases and water from the pretreated coal mixture;

(c) forming a subsequent mixture of said pretreated coal, organic solvent, and a catalyst, wherein the catalyst is comprised of dispersed submicron size particles of a metal sulfide-containing compound, said metal being selected from the group consisting of Groups VA, VIA, VIIA, and VIIIA of the Periodic Table of the Elements and mixtures thereof, said catalyst being present in the mixture in an amount ranging from about 10 to less than 5000 weight parts per million, calculated as the elemental metal, based on the weight of coal in said mixture, and wherein the catalyst is formed in situ from an oil-soluble precursor metal compound;

(d) reacting the resulting mixture containing said catalyst under coal hydroconversion conditions in the presence of hydrogen, in a hydroconversion zone; and (e) separating the contents of said hydroconversion zone into at least three fractions; (1) an effluent product comprising a hydrocarbonaceous liquid; essentially free of coal residue solids; (2) a bottoms comprising coal residue solids; and (3) a gaseous top;

wherein said hydrocarbonaceous liquid is fractionated, whereby at least a fraction thereof is recycled to the hydroconversion zone; wherein at least a portion of said bottoms is subjected to partial oxidation, whereby carbon monoxide for step (a) above and hydrogen for step (d) is produced; and wherein said top comprises hydrogen which is recycled to the hydroconversion zone.

* * * * *